US005632395A

United States Patent [19]

Zimmermann

[11] Patent Number: 5,632,395

[45] Date of Patent: May 27, 1997

[54] TELESCOPIC ROD

[76] Inventor: Horst Zimmermann, Suchardstrasse 23, A-6700 Bludenz, Austria

[21] Appl. No.: 388,807

[22] Filed: Feb. 15, 1995

[30] Foreign Application Priority Data

Feb. 25, 1994 [AT] Austria ..... 395/94

[51] Int. Cl.[6] ..... E04H 12/34

[52] U.S. Cl. ..... 212/350; 212/230

[58] Field of Search ..... 212/292, 296, 212/264, 349, 350, 231, 230; 52/118

[56] References Cited

U.S. PATENT DOCUMENTS

| | | | |
|---|---|---|---|
| 3,722,154 | 3/1973 | Sakamoto et al. | 212/349 |
| 3,792,555 | 2/1974 | Sung | 212/349 |
| 4,946,051 | 8/1990 | Cliff | 212/264 |

FOREIGN PATENT DOCUMENTS

| | | |
|---|---|---|
| 0476225 | 4/1991 | European Pat. Off. . |
| 2018926 | 8/1971 | Germany . |
| 214833 | 10/1984 | Germany . |

*Primary Examiner*—Thomas J. Brahan

*Attorney, Agent, or Firm*—Friedrich Kueffner

[57] ABSTRACT

A telescopic rod with a plurality of tubular rod sections which are mounted so as to be slidable within each other, and with a multistage piston-cylinder unit arranged within the telescopic rod. The multistage piston-cylinder unit is connected, on the one hand, to the outermost rod section of the telescopic rod and, on the other hand, to the last inner rod section of the telescopic rod. Radially adjustable abutments are provided on the inner base portions of at least some of the rod sections, wherein the abutments are directed toward the outer surfaces of the extended stages of the piston-cylinder unit and can be placed in contact with the outer surfaces. Stationary abutments may be arranged on the first and last rod sections of the row of rod sections of the telescopic rod, wherein the stationary abutments are arranged adjacent the outer surfaces of the corresponding stages of the piston-cylinder unit when the piston-cylinder unit is extended.

16 Claims, 5 Drawing Sheets

TELESCOPIC ROD

BACKGROUND OF THE INVENTION

1. Field of the Invention

The present invention relates to a telescopic rod with a plurality of tubular rod sections which are mounted so as to be slidable within each other, and with a multistage piston-cylinder unit arranged within the telescopic rod. The multistage piston-cylinder unit is connected, on the one hand, to the outermost rod section of the telescopic rod and, on the other hand, to the last inner rod section of the telescopic rod.

2. Description of the Related Art

Telescopic rods of the above-described type are used, for example, as telescopic jibs in a vehicle crane or rail crane, as a jib of a truck loading crane or as a telescope arm of a work platform. The telescopic rod has a plurality of tubular rod sections which are slidable into one another. The cross-section of these tubular rod sections may be round, oval or polygonal. In the latter case, the rod sections are box-shaped sectional members. The multistage piston-cylinder unit used for extending the telescopic rod is mounted within the rod and the number of stages may correspond to the number of rod sections of the telescopic rod. However, this does not necessarily have to be the case. For retracting the telescopic rod, usually a separate return device is provided. This return device may be composed of a rope or a chain which is arranged within the telescopic rod and is connected, on the one hand, to the last extendable rod section and, on the other hand, to a winding device.

When the telescopic rod or the piston-cylinder unit are extended, the resistance against collapsing stress applied to the extended piston rod is decreased in proportion to the extent by which the telescopic rod has been extended, i.e., in dependence on the length of the extended portion of the piston rod or the effective length of each rod section. Accordingly, an increasing length of the telescopic rod in the extended state requires an increase in the resistance against collapsing stress. Since cranes with great lifting heights are required in actual use, each rod section of the extendable telescopic rod must have a very great length and, consequently, a piston-cylinder unit is required which has a very long piston rod, so that one of the long rod sections can be extended and retracted relative to another of the other rod sections over the necessary distance. When the extended portion of the piston rod has a very long length, usually a piston rod with a great diameter is provided which has the necessary resistance to buckling. However, when the diameter of the piston rod is increased, a cylinder must be provided whose dimensions are also greater, so that the cylinder has a greater weight and the manufacturing costs are increased.

Accordingly, it has been attempted to develop means for preventing buckling of an extended piston-cylinder unit in a telescopic rod. Means of this type are described and illustrated in DE-OS 20 18 926. In that case, a carriage is provided which is displaceably mounted on the piston rod of the piston-cylinder unit. The carriage has radially outwardly directed rigid arms which rest through rollers or slide blocks against the inner side of the respectively following rod section. The carriage is provided with drive means which are guided through transmissions in a such a way that, in the case of a given extended distance of two rod sections, the carriage guided on the piston rod travels only half this given extended distance. This is effected partially by means of cable pull devices, partially by means of racks and pinions or by means of drive members acting against spring pull devices. All of these measures are structurally complicated and, therefore, not useful.

SUMMARY OF TEE INVENTION

Therefore, it is the primary object of the present invention to provide a telescopic rod in which the safety against buckling of the multistage piston-cylinder unit is improved or increased with structurally simple means.

In accordance with the present invention, radially adjustable abutments are provided on the inner base portions of at least some of the rod sections, wherein the abutments are directed toward the outer surfaces of the extended stages of the piston-cylinder unit and can be placed in contact with the outer surfaces. Stationary abutments may be arranged on the first and last rod sections of the row of rod sections of the telescopic rod, wherein the stationary abutments are arranged adjacent the outer surfaces of the corresponding stages of the piston-cylinder unit when the piston-cylinder unit is extended.

Accordingly, in accordance with the proposal of the present invention, a high stiffness to buckling of the piston-cylinder unit is achieved by providing collar-like abutments in the base portions of some individual rod sections, and by abutments which automatically adapt to the different diameters of the individual stages of the piston-cylinder unit, without requiring separate and complicated drive means.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF TEE PREFERRED EMBODIMENTS

Figure 1:
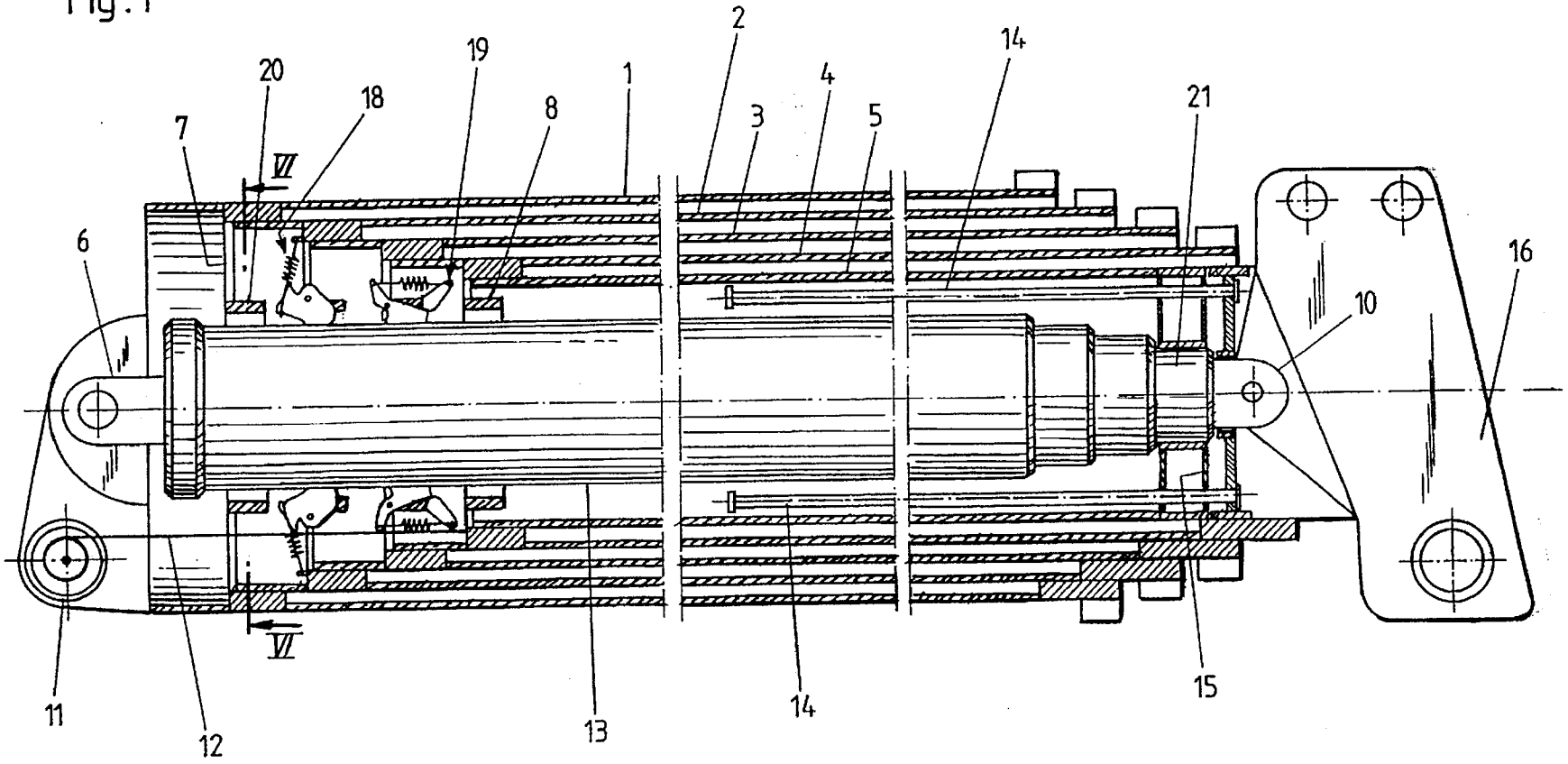
FIG. 1 is a schematic longitudinal sectional view of a retracted telescopic rod according to the present invention.

FIG. 1 of the drawing shows the telescopic rod according to the present invention in the retracted position. In the illustrated embodiment, the telescopic rod has five rod sections 1, 2, 3, 4, 5 which can be slid into one another. The rod sections have a circumferentially closed cross-section. This cross-section may be round, oval, or also polygonal.

The first rod section 1 is mounted at one end thereof in a manner which is not illustrated and which depends essentially on how the telescopic rod is used. If it is used as a jib of a vehicle crane, the telescopic rod is swingable about an axis extending perpendicularly to the drawing plane and an axis extending in the drawing plane.

The individual rod sections 1–5 are guided in a suitable manner so as to slide into one another. A multistage, simple-acting piston-cylinder unit 13 is arranged within the rod sections 1–5. The piston-cylinder unit is connected only to the first rod section 1 at the end 6 and to the last rod section 5 at the other end 10. The number of stages of the piston-cylinder unit 13 may be different than the number of rod sections 1–5 of the telescopic rod. The rod section 5 which is the last in the row of rod sections has at its free end a head flange 16. Other structural elements may also be secured to the free end of the last rod section, depending on what the telescopic rod is going to be used for.

Figure 6:
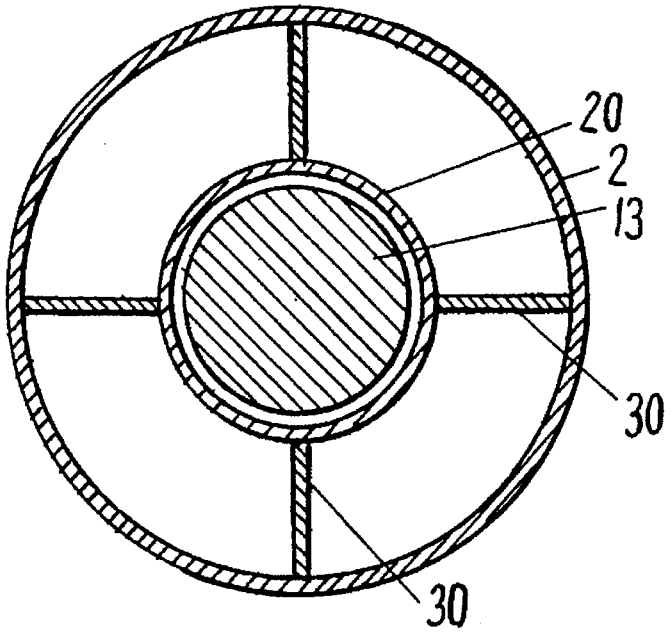
FIG. 6 is a transverse sectional view taken along sectional line VI—VI of FIG. 1.
Figure 7:
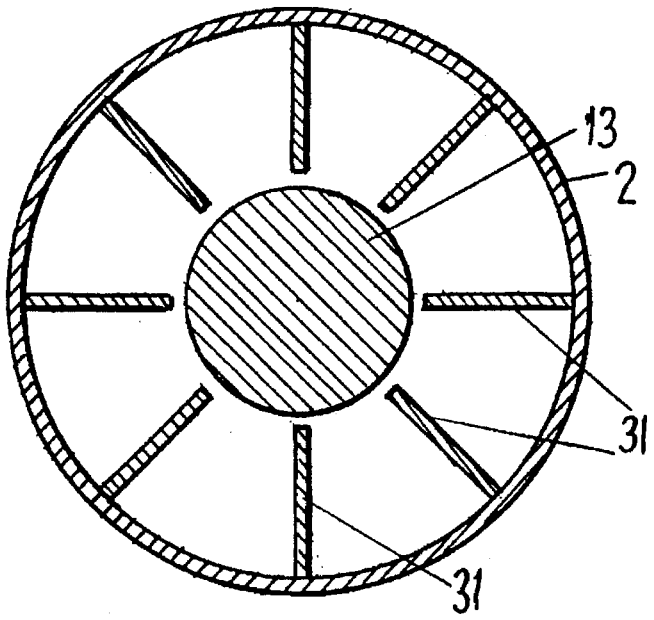
FIG. 7 is a transverse sectional view, similar to FIG. 6, of another embodiment of the invention.

A stationary abutment 7 is provided in the base portion of the second rod section 2. This abutment 7 is composed of a ring 20 which surrounds the piston-cylinder unit 13 with some play. As shown in detail in FIG. 6, a ring 20 is connected through spoke-like brace members 30 to the inner side of the base portion of the second rod section 2. Individual radially extending webs 31, shown in FIG. 7, may also be provided instead of such a ring 20.

A collar 15 is secured at the free end of the second to last stage 21 of the piston cylinder unit 13. A plurality of guide rails 14 extending parallel to the axis of the telescopic rod are displaceably mounted in the collar 15. The outer ends of the guide rails 14 are connected to a hub 22 which is displaceably mounted within the last rod section 5 and which preferably rests against the inner wall of this rod section 5. The last stage 23 of the piston-cylinder unit 13 extends with little play concentrically through the hub 22.

An additional abutment 8 comparable to the stationary abutment 7 is arranged in the base portion of the last rod section 5.

In the base portions of the rod sections 3 and 4 located between the above-described rod sections 1, 2 and 5, radially adjustable abutments 18 and 19 are provided, wherein the abutments 18 and 19 are directed toward the outer surfaces of the extendable stages of the piston-cylinder unit 13 and may be placed in contact with the extendable stages of the piston-cylinder unit 13. These abutments 18 and 19 are constructed as pivotally mounted pawls 24 and 25, wherein a plurality of pawls 24 and 25 are arranged distributed over the inner circumference of the rod sections 3 and 4. Advantageously, at least three such abutments are arranged distributed over the inner circumference with equal arc spacings. The individual pawls 24 and 25 are biased by springs 26 and 27. The pivot axes of these pawls 24 and 25 are located in the cross-sectional planes of the rod sections and the pivot planes of the pawls 24 and 25 are located in the longitudinal plane which includes the longitudinal median plane of the telescopic rod.

Figure 4:
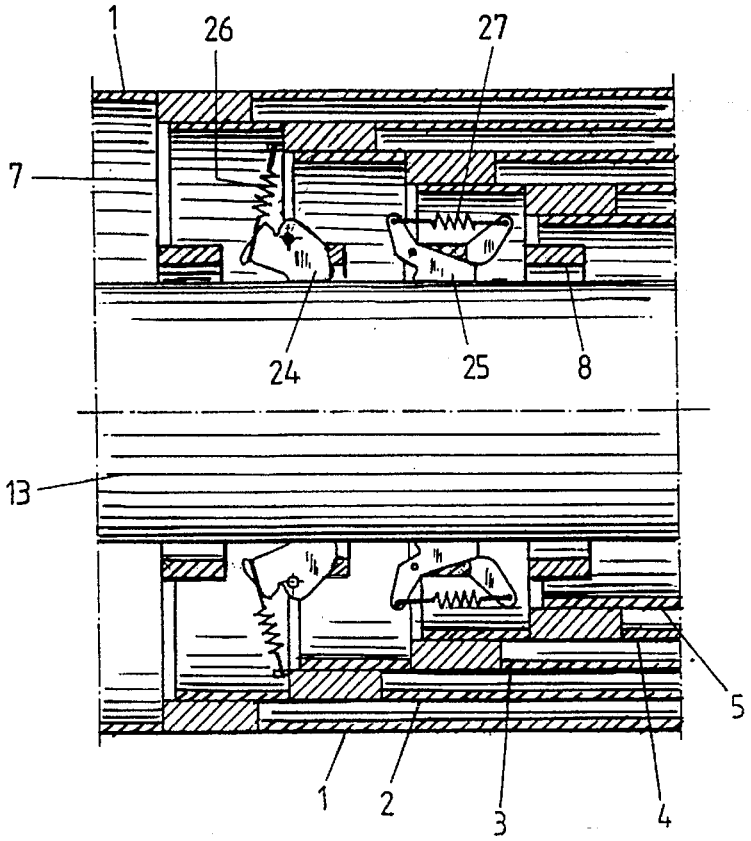
FIGS. 4 and 5 are schematic sectional views, on a larger scale, of a part of the telescopic rod, showing the pivotable abutments in two different positions of operation.
Figure 5:
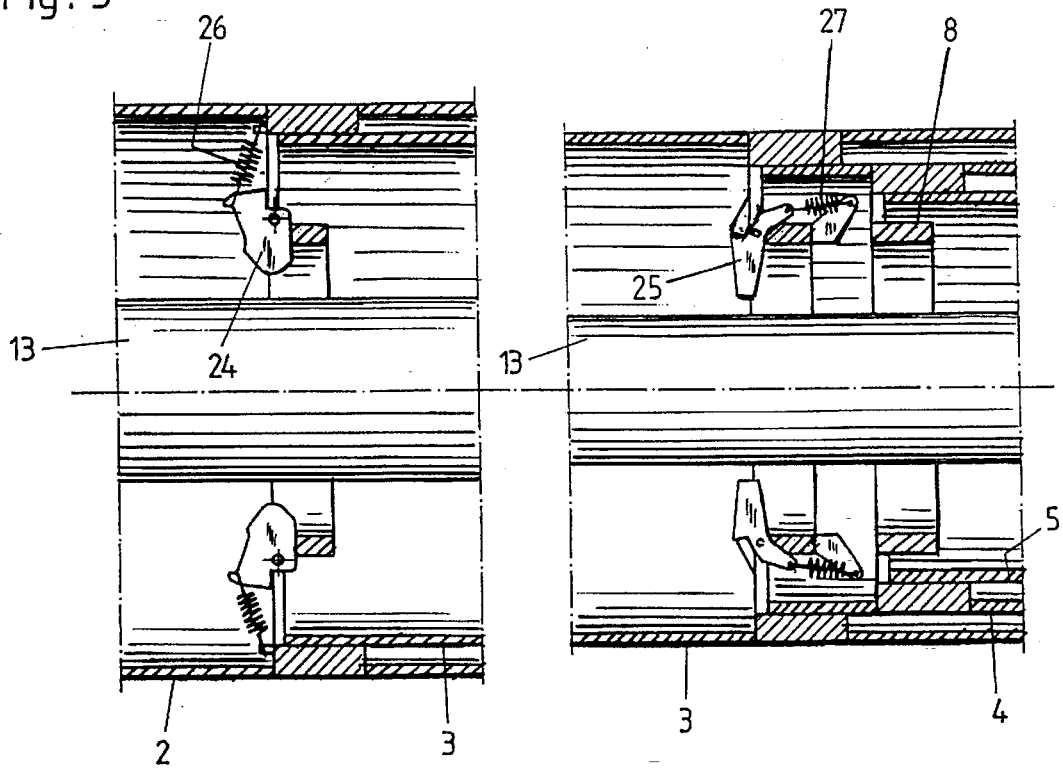

The torque produced by the springs 26, 27 is directed against the direction in which the piston-cylinder unit 13 is extended. The pawls 24 and 25 can be constructed in such a way that, in the swung-in position, they rest either directly against the respective stage of the piston-cylinder unit 13, or support surfaces of the pawls 24 and 25 are at least immediately located adjacent the stages of the piston-cylinder unit 13. Advantageously, the pawls 24 and 25 are mounted in such a way that, in the swung-in position, they assume a locked dead center position, so that a force acting on the support surfaces in radial direction in relation to cross-sectional planes of the telescopic rod, cannot move the pawls out of their swung-in position, as illustrated in FIG. 4 of the drawing.

Figure 2:
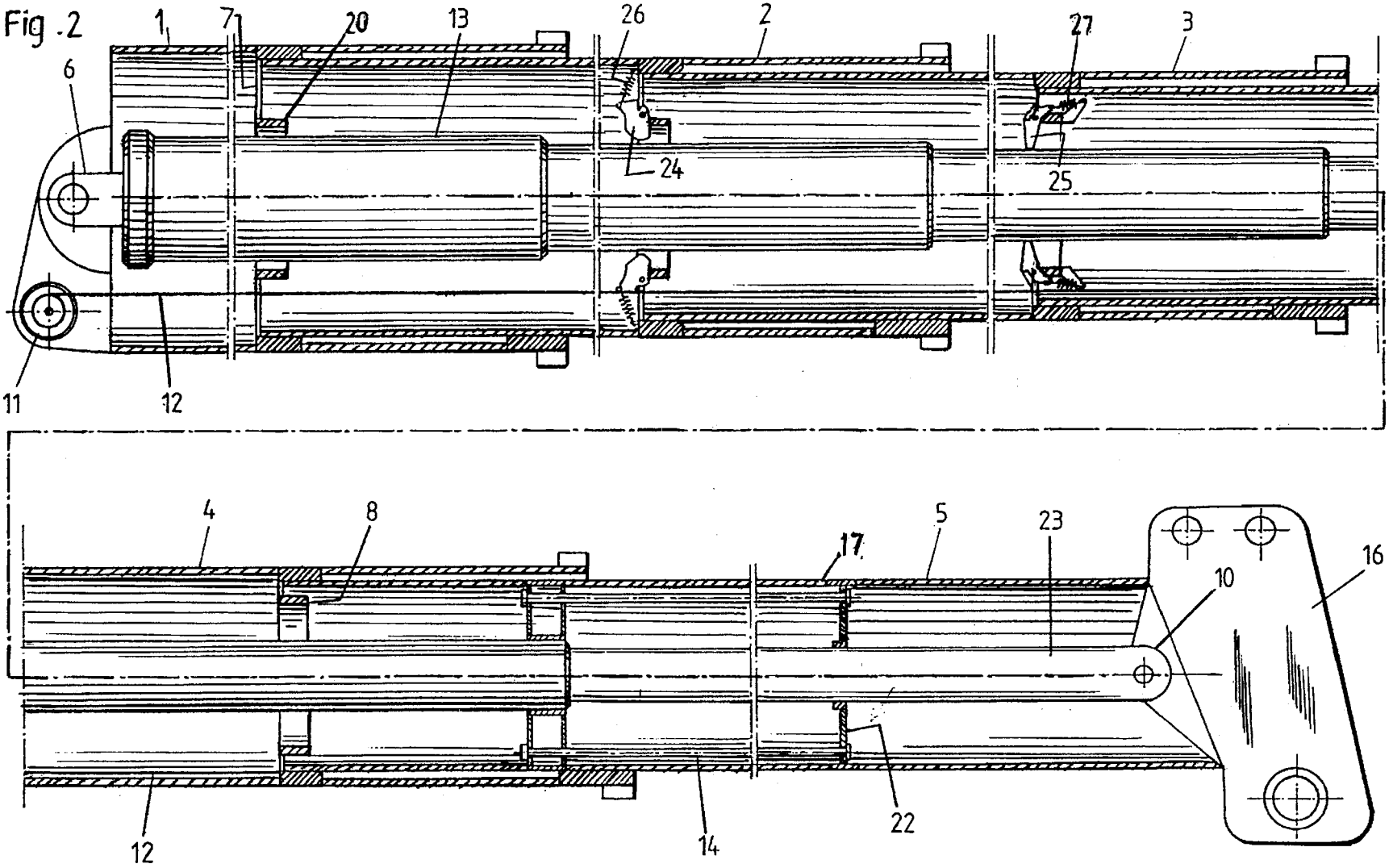
FIG. 2 is a schematic longitudinal sectional view of the fully extended telescopic rod of FIG. 1.
Figure 3:
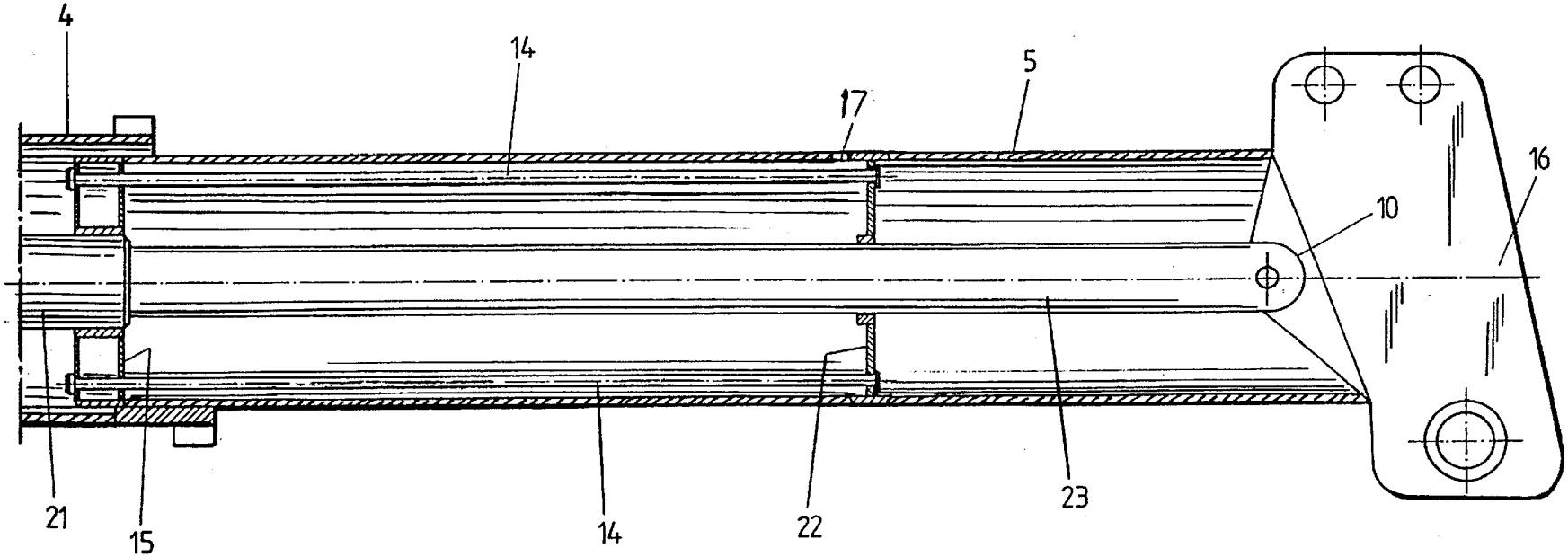
FIG. 3 is a schematic sectional view of the last stages of the piston-cylinder unit.

When pressure is applied to the piston-cylinder unit 13, the individual stages of the piston-cylinder unit 13 are extended starting from the position shown in FIG. 1 until the position of the individual structural components shown in FIG. 2 is finally reached. With respect to the present invention, it is not of significance in what sequence the individual stages of the simple-acting piston-cylinder unit 13 are extended. Various possibilities are possible: the individual stages are extended successively in accordance with their diameters, wherein either the stage with the greatest diameter or the stage with the smallest diameter is first; another possibility is that the individual stages are extended in a random sequence.

As is apparent from the figures of the drawings, the pawls 24 in the base portion of the rod section 3, which initially rest as a result of the action of the spring 26 against the outer surface of the first stage of the piston-cylinder unit 13, are pivoted by the force exerted by this spring as soon as the base portion of this rod section 3 has passed the first stage of the piston-cylinder unit 13. The spring 26 pivots the pawl 26 against a stop, so that the support surface of the pawl is located with a slight play opposite to or rests against the outer surface of the corresponding stage of the piston-cylinder unit 13. The pivoting angle, the position of the stop and the position of the support surface of the pawl relative to the pivot axis are adjusted to each other in such a way that a force acting in radial direction relative to the transverse cross sections of the telescopic rod on the surface of the pawl cannot pivot the pawl, so that the pawls carry out their support function in the event of a high or eccentric load acting on the telescopic rod and any slight lateral displacement of the piston-cylinder unit 13 resulting therefrom.

Since the telescopic rod is equipped with a simple-acting piston-cylinder unit, a separate device is provided for retracting the telescopic rod. In the illustrated embodiment, the retracting device is composed of a steel rope 12 and a winding device 11. The steel rope 12 extends within the rod sections and its end is connected to the last rod section 5.

In the base portions of the rod sections 2 and 5, the above-mentioned support function is carried out by the stationary abutments 7 and 8, as described above.

The lateral support of the last and smallest stage of the piston-cylinder unit 13 is carried out by the hub 22 in connection with the collar 15 and the guide rails 14. The manner of operation of these components is described above and illustrated in the drawing. In order to achieve a defined position of the hub 22, a stop member 17 is provided which is secured to the inner wall of the rod section 5.

When the telescopic rod is retracted by means of the steel rope 12 and the winding device 11, the swung-out, spring-biased pawls 24 and 25 serving as abutments are automatically pivoted back into their initial positions by the steps formed by the different diameters of the individual stages of the piston-cylinder unit 13.

For laterally supporting the individual stages of the extended and stressed piston-cylinder unit 13, simple mechanical means have been described above. It is also conceivable to use complicated, mechanically, hydraulically or pneumatically operating solutions, wherein the components are arranged in the individual transverse cross sectional planes and are automatically adapted to the respective diameters of the stages of the piston-cylinder unit 13 to be supported.

The measures according to the present invention make it possible in a multistage or multi-part piston-cylinder unit 13, to keep the outer diameters of the unit 13 as small as possible, while still being able to transmit very high forces. This is because the safety against buckling has been significantly improved over previously known measures. The means used for the lateral support have relatively small dimensions, while still being able to significantly increase the safety against buckling of the extended and stressed telescopic rod. This is because experience has shown that only very small laterally acting forces are required for avoiding buckling of a rod-shaped structural element.

The invention is not limited by the embodiments described above which are presented as examples only but can be modified in various ways within the scope of protection defined by the appended patent claims.

I claim:

1. A telescopic rod comprising a plurality of rod sections which are mounted so as to be telescopically axially slidable relative to each other between an extended position and a retracted position, the rod sections including a first outermost rod section, a last inner rod section, and at least one rod section between the outermost rod section and the inner rod section, a multistage piston-cylinder unit with a plurality of stages having outer surfaces, the piston-cylinder unit being movable between an extended position and a retracted position, the piston-cylinder unit being connected to the outermost rod section and to the inner rod section, the rod sections having base portions with inner peripheries, a radially adjustable abutment being mounted on the inner periphery of the base portion of the at least one rod section between the outermost rod section and the inner rod section, the radially adjustable abutment being directed toward the outer surfaces of a stage of the piston-cylinder unit when the piston-cylinder unit is in the extended position thereof, so that the radially adjustable abutment contacts the piston-cylinder unit when the piston-cylinder unit yields radially under load, further comprising stationary abutments mounted on the outermost rod section and on the inner rod section, the stationary abutments being located adjacent the outer surfaces of the stages of the piston-cylinder unit when the piston-cylinder unit is in the extended position thereof.

2. The telescopic rod according to claim 1, wherein the radially adjustable abutment comprises pivotally mounted pawls.

3. The telescopic rod according to claim 2, wherein the pawls have pivoting axes, the pivoting axes of the pawls being located in transverse planes of the rod sections.

4. The telescopic rod according to claim 2, wherein the pawls have pivoting planes, the telescopic rod having a longitudinal center axis, wherein the pivoting planes of the pawls are located in a longitudinal plane including the longitudinal center axis of the telescopic rod.

5. The telescopic rod according to claim 2, comprising springs for biasing the pawls.

6. The telescopic rod according to claim 5, further comprising stop members for holding the pawls in a dead center position against a force of the springs.

7. The telescopic rod according to claim 5, wherein the springs exert a torque on the pawls, the torque being directed against a direction of extension of the piston-cylinder unit.

8. The telescopic rod according to claim 1, wherein the radially adjustable abutment comprises three pivotally mounted pawls, the pawls being arranged distributed over the inner periphery thereof with equal arc spacings.

9. The telescopic rod according to claim 1, wherein the piston-cylinder unit has a second to last stage, the second to last stage having a free end, a collar being mounted on the free end of the second to last stage of the piston-cylinder unit, a plurality of guide rails extending parallel to the telescopic rod axis being displacably mounted in the collar, the guide rails having outer ends connected to a hub which is displacably mounted within the inner rod section, wherein the last stage of the piston-cylinder extends with little play concentrically through the hub.

10. The telescopic rod according to claim 9, wherein the hub rests against an inner wall of the inner rod section.

11. The telescopic rod according to claim 1, comprising a stationary abutment mounted on the inner periphery of the base portion of the second rod section adjacent the outermost rod section, the stationary abutment being a ring, the piston-cylinder unit extending through the ring with play.

12. The telescopic rod according to claim 1, comprising a stationary abutment on the inner periphery of the base portion of the second rod section adjacent the outermost rod section, the stationary abutment comprising a plurality of webs extending to the outer surface of the stages of the piston-cylinder unit.

13. The telescopic rod according to claim 1, wherein the piston-cylinder unit is a simple-acting unit, further comprising a flexible pull member for retracting the telescopic rod from the extended position thereof, the pull member extending along the rod sections and being connected to the inner rod section, and a winding up device for winding up the pull member.

14. The telescopic rod according to claim 13, wherein the pull member is a chain or a steel rope.

15. The telescopic rod according to claim 13, wherein the winding device is mounted within the rod sections.

16. The telescopic rod according to claim 13, wherein the winding device is mounted outside of the rod sections.

* * * * *